US012146427B2

(12) United States Patent
Ferrario et al.

(10) Patent No.: US 12,146,427 B2
(45) Date of Patent: Nov. 19, 2024

(54) SWITCHABLE ROCKER ARM FOR CONTROLLING THE LIFT OF A VALVE BRIDGE OR A SINGLE VALVE OF VALVE TRAIN GROUP OF AN INTERNAL COMBUSTION ENGINE AND VALVE TRAIN GROUP COMPRISING AT LEAST A SUCH SWITCHABLE ROCKER ARM

(71) Applicant: STREPARAVA S.P.A. CON SOCIO UNICO, Adro (IT)

(72) Inventors: Davide Ferrario, Adro (IT); Francesco Mega, Adro (IT); Matteo Magni, Adro (IT)

(73) Assignee: STREPARAVA S.P.A. CON SOCIO UNICO, Adro (IT)

( * ) Notice: Subject to any disclaimer, the term of this patent is extended or adjusted under 35 U.S.C. 154(b) by 0 days.

(21) Appl. No.: 18/247,005

(22) PCT Filed: Sep. 21, 2021

(86) PCT No.: PCT/IB2021/058597
§ 371 (c)(1),
(2) Date: Mar. 28, 2023

(87) PCT Pub. No.: WO2022/069998
PCT Pub. Date: Apr. 7, 2022

(65) Prior Publication Data

US 2023/0366335 A1 Nov. 16, 2023

(30) Foreign Application Priority Data

Sep. 30, 2020 (IT) ..... 102020000023077

(51) Int. Cl.
*F01L 13/00* (2006.01)
*F01L 1/18* (2006.01)
(Continued)

(52) U.S. Cl.
CPC ..... *F01L 13/0005* (2013.01); *F01L 1/181* (2013.01); *F01L 1/2411* (2013.01); *F01L 1/267* (2013.01);
(Continued)

(58) Field of Classification Search
CPC ..... F01L 13/0005; F01L 1/181; F01L 1/2411; F01L 2001/186; F01L 1/18; F01L 13/06; F01L 2305/00
See application file for complete search history.

(56) References Cited

U.S. PATENT DOCUMENTS

2005/0188930 A1 9/2005 Best
2012/0024260 A1* 2/2012 Groth ..... F01L 1/18 123/321
(Continued)

FOREIGN PATENT DOCUMENTS

DE 102016219695 A1 * 4/2018 ..... F01L 1/18
DE 102018132857 6/2020
(Continued)

OTHER PUBLICATIONS

International Search Report and Written Opinion issued in connection with Application No. PCT/IB2021/058597, dated Jan. 31, 2022 (12 pages).
(Continued)

*Primary Examiner* — Wesley G Harris
(74) *Attorney, Agent, or Firm* — KLINTWORTH & ROZENBLAT IP LLP

(57) ABSTRACT

A switchable rocker arm to control the lift of a valve bridge or of a single valve of a valve train group of an internal combustion engine; the switchable rocker arm being able to rotate around a first axis and comprising: a cam body, which is configured to be rotated by a cam; a valve body, which is configured to act upon the valve bridge or the single valve;
(Continued)

wherein the switchable rocker arm can selectively be switched between a first configuration, in which the rotation of the cam body around the axis generates a movement of the valve body, and a second configuration, in which the rotation of the cam body around the axis does not generate any movement of the valve body.

11 Claims, 7 Drawing Sheets

(51) Int. Cl.
*F01L 1/24* (2006.01)
*F01L 1/26* (2006.01)
*F01L 13/06* (2006.01)

(52) U.S. Cl.
CPC ..... *F01L 13/06* (2013.01); *F01L 2001/186* (2013.01)

(56) References Cited

U.S. PATENT DOCUMENTS

2014/0251266 A1* 9/2014 Emmons ..... F02D 13/04 123/321
2017/0009610 A1* 1/2017 Ahmed ..... F01L 1/2416

FOREIGN PATENT DOCUMENTS

FR 2990484 A1 * 11/2013 ..... F01L 1/181
KR 20110112390 A * 10/2011 ..... F02D 13/04
WO WO-2006090292 A2 * 8/2006 ..... F01L 1/18
WO 2020020492 1/2020
WO WO-2021047796 A1 * 3/2021 ..... F01L 1/181

OTHER PUBLICATIONS

PCT Direct Letter submitted in connection with PCT/IB2021/058597, dated Sep. 20, 2021 (14 pages).

* cited by examiner

SWITCHABLE ROCKER ARM FOR CONTROLLING THE LIFT OF A VALVE BRIDGE OR A SINGLE VALVE OF VALVE TRAIN GROUP OF AN INTERNAL COMBUSTION ENGINE AND VALVE TRAIN GROUP COMPRISING AT LEAST A SUCH SWITCHABLE ROCKER ARM

CROSS-REFERENCE TO RELATED APPLICATIONS

This patent application claims priority from Italian patent application no. 102020000023077 filed on 30 Sep. 2020, the entire disclosure of which is incorporated herein by reference.

TECHNICAL FIELD

The invention relates to the industry of internal combustion engines, in particular internal combustion engines for heavy vehicles provided with a plurality of cylinders, each provided with intake valves and exhaust valves. Specifically, the invention relates to the valve train group of said engines, namely the structure comprising a plurality or rocker arms configured to control the lift of the valves starting from an activation through a camshaft. In this technical field, the invention deals with the problem of how to make a "switchable" rocker arm innovative. As it is known, the expression "switchable" rocker arms indicates a rocker arm which is selectively capable, on the one hand, of enabling the execution of traditional intake and exhaust cycles of a 4-stroke engine established by the profile of the camshaft and, on the other hand, of controlling the lifts of the valves not corresponding to the profile of the cams so as to enable, for example, the execution of the so-called engine brake with a single or double braking per cycle.

STATE OF THE ART

As mentioned above, the invention relates to a switchable rocker arm, namely a device configured to control the lift of a valve or of a support bridge of two valves in an internal combustion engine, so that, when needed, the lift of the valve or of the valve bridge is independent of the profile of the cam acting upon the rocker arm itself. The traditional structure of a cam-operated rocker arm for controlling the lift of a valve of an internal combustion engine is well known to a person skilled in the art. In general, a rocker arm of this type is a body rotating around an axis parallel to the axis of the camshaft and comprising a cam portion in contact with the cam and a valve portion in contact with the valve or the valve body. During the rotation of the camshaft, the cam acts upon the cam portion of the rocker arm, thus generating a rotation thereof around its own axis, with a consequent movement of the valve portion. Said valve portion directly acts upon a valve or a valve bridge, controlling the lift thereof based on the cam profile. Prior art documents dealt, in the past, with the problem of how to control at least one exhaust valve of an engine so as to obtain a so-called engine brake, namely a cycle in which at least one exhaust valve remains closed (not lifted) for a longer amount of time than usual. In this way, the kinetic energy of the engine is partly absorbed by the exhaust stroke of the piston, which, finding the valve in a closed condition, acts in a compressing manner, thus dissipating energy. To this aim, the solution suggested in the past and nowadays still largely applied in the industry is to provide the valve train group with at least one further rocker arm in addition to the rocker arms already available, which act upon the valve bridges, in particular providing a rocker arm known as "engine brake" rocker arm, which acts upon an exhaust valve bypassing the relative valve bridge. Many patent documents disclosing an "engine brake" rocker arm of the type described above are available. By way of example of the large quantity of documents on engine brake rocker arms and in order to prove how the issue is well known to a person skilled in the art, prior art document EP2425105 can be mentioned.

Starting from this configuration, prior art documents also faced the problem of how to further control the lift of the exhaust valves in order to obtain not only one braking phase (which is what the engine brake rocker arm enables), but two braking phases per cycle. This problem was solved by providing a so-called "switchable rocker arm", namely by providing a rocker arm operating the bridge of the exhaust valves, which can selectively be switched between a work configuration, in which the lift of the valves is carried out based on the profile of the cam, like in traditional rocker arms, and a deactivated configuration, in which the rotation of the cam still acts upon the cam portion of the rocker arm, but does not generate any longer a corresponding movement of the valve portion of the rocker arm itself. The combination of the presence of a switchable rocker arms and of an engine brake rocker arm allows manufacturers to carry out a double braking phase per cycle. By way of example of the large numbers of documents on switchable rocker arms and in order to prove how the field is well known to a person skilled in the art, prior art documents WO9932773 and EP2625395 can be mentioned. A switchable rocker arm usually is an assembly obtained by joining two distinct bodies, wherein a first body is called cam body and cooperates with the cam and the second body is called valve body and cooperates with the valve bridge. These two bodies can assume different configurations. In a first configuration, they are integral to one another as if they were one single piece and the rotation transmitted by the cam to the cam body generates a consequent movement of the valve body (normal activation of the valves). In a second configuration, the two bodies are not integral to one another any longer, so that the rotation transmitted by the cam to the cam body does not generate any longer a consequent movement of the valve body.

As explained more in detail in the description of the invention below, this patent application deals with the problem of how to provide a switchable rocker arm of the type described above with an innovative selective coupling and release device for the two cam and valve bodies in order to obtain the two configurations described above.

By the way, a switchable rocker arm of the type described in prior art documents and disclosed in this invention can also be used for purposes other than a double braking per cycle. In other words, the presence, in a valve train group, of a switchable rocker arm can also be independent of the presence of an engine brake rocker arm. A switchable rocker arm can act not only upon a valve bridge, but also upon one single valve and, furthermore, it can be coupled not only to exhaust valves, but also or only to intake valves. Therefore, generally speaking, even if a switchable rocker arm nowadays has its most useful application in combination with an engine brake rocker arm in order to obtain a double braking, the invention can find larger application in the general field of the control of the lift of a valve or of a valve bridge in order to establish special intake and exhaust cycles not linked to the cam profile.

WO2020020492 discloses a switchable rocker arm comprising a cam body configured to be rotated by a cam and a valve body configured to act upon a valve bridge or a single valve. According to WO2020020492, the selective locking device of the two bodies can comprise locking balls, which cooperate with a shaped movable piston. According to WO2020020492, in an active configuration, the rocker arm rotates around the axis carrying the rocker arm, whereas, in a deactivated configuration, the valve body remains still and the cam body rotates around a rotation centre, which is different from the axis carrying the rocker arm.

DESCRIPTION OF THE INVENTION

The object of the invention is to provide an inventive switchable rocker arm to control the lift of a valve bridge or of a single valve of a valve train group of an internal combustion engine. In particular, the switchable rocker arm according to the invention is rotating around one single axis A1 (claimed as first axis A1) and comprises two bodies, namely:

- a cam body, which is configured to be rotated by a cam;
- a valve body, which is configured to act upon the valve bridge or upon the single valve;

wherein the switchable rocker arm is selectively switchable between a first configuration, in which the rotation of the cam body around the axis A1 generates a movement or rotation of the valve body around the axis A1, and a second configuration, in which the rotation of the cam body around the first axis A1 does not generate any movement of the valve body.

Naturally, both the cam body and the valve body can be obtained by joining different elements in an integral manner, for example the cam body can consist of two half-shells joined to one another in an irreversible manner.

In this configuration, namely with the rocker arm comprising two bodies which are selectively integral to one another or selectively rotating relative to one another, the main aspect of the invention concerns how to firmly hold these two configurations and how to switch from the first one to the second one and vice versa in the presence of one single rotation axis A1 in both configurations.

Having one single rotation axis in both configurations represents a preferable solution. Having different axes for the two configurations means making the system more complex, making suitable holes to house pins that change the mechanical behaviour of the device (which, for it is stressed at high frequencies, must be carefully designed) and introducing further elements that are likely to break.

In particular, according to the invention, a cylinder for a sliding piston is obtained inside either the cam body or the valve body (hence, in only one of the two bodies) Hence, the piston never comes out of its own body and never enters, even partially, the other body. The piston is movable in the cylinder between a first position and a second position. The switchable rocker arm comprises a locking device (two examples thereof are described below), which cooperates with the aforesaid piston. In particular, the locking device is configured so that:

- in the first position of the piston, the locking device simultaneously acts upon the cam body and upon the valve body so as to constrain the switchable rocker arm in the first configuration;
- in the second position of the piston, the locking device enters the cylinder so that the switchable rocker arm is in the second configuration and the rotation of the cam body does not generate a rotation of the valve body.

According to two different embodiments, the locking device can comprise two balls or a pin. In both cases, there is a locking axis A2 parallel to the rotation axis A1. In case there are two balls, as described in detail below, the axis A2 is the axis along which the balls move, whereas, in the second case, the axis A2 is the axis of the pin. In both cases, the piston is shaped, namely it comprises at least a recess or a portion with a reduced section, so that, in the second position, it faces the balls or the pin in such a way that the locking device can penetrate the cylinder. On the contrary, in the first position, the ball or pin locking device is in contact with a wide portion of the piston, so that the locking device (balls or pin, for example) is between the cam and valve bodies and acts upon both of them as a mechanical bridge, making them integral. Preferably, the transition from the wide portion to the recess of the piston takes place in a gradual manner, providing progressively smaller sections of the profile of the piston.

In the embodiment with locking balls, they are housed, at first (first configuration), in a spherical half-seat obtained in a body, for example the cam body, and between an opening made in the cylinder, for example obtained in the valve body. When the piston is in the second position, the balls leave the spherical half-seat and completely penetrate the cylinder, moving along the axis A2 parallel to the axis A1 of the device. The balls are arranged at 180° relative to one another, namely are diametrically opposite relative to the cylinder.

In the embodiment with a pin, the latter is integral to one of the two bodies, for example to the cam body, and the piston has one single C-shaped seat to receive the pin (with an axis that is orthogonal to the axis of the piston). In this case, again, in the first configuration, the pin is between the cylinder, so that the rotation of the cam body generates a movement of the valve body. After having penetrated the cylinder (second position of the piston), even if the pin is integral to the cam body, a rotation of the latter does not generate a movement of the valve body.

Preferably, the shaped cylinder is hydraulically operated and a spring is provided, which is configured to force the piston in the first position, namely to keep the device active. Hence, in case of a lack of supply, the rocker arm always in the first, non-deactivated configuration.

Preferably, between the cam body and the valve body there is a spring, which is also configured to force the switchable rocker arm in the first configuration.

The position of the spring between the bodies as well as the position of the piston and of the relative locking device can be different from the examples described herein in order to fulfil different needs in terms of dimensions or inertia of the system. According to an important aspect of the invention, the rocker arm must always fulfil a geometric/mechanical condition, which is not arbitrary, but is identified in order to control the stresses affecting the locking device. In order to explain this condition in detail, a new element must be introduced, namely the roller, which is arranged at the free end of the cam body, is configured to be operated by (namely, be in contact with) the cam and repents the point of application of the force of the cam. Said roller comprises a third axis A3, which is parallel to the first axis A1 (and, hence, also to the second axis A2). In the configuration of the rocker arm according to the invention, with one single rotation axis A1 in all configurations, the condition set by the invention is that the distance A between the first axis A1 and the second axis A2 is greater than 0.75 times the distance B between the first axis A1 and the third axis A3. This condition ensures that the stress affecting the balls or the pin (locking devices) in the active rocker arm condition does not exceed threshold values, which could lead to a damaging of the device itself.

Indeed, the invention introduces a further inventive aspect of the device concerning the selective locking device. Said device will be described and claimed herein as integrated in the rocker arm according to the first claim, but it could also be installed in other switchable rocker arms and, hence, become the subject-matter of corresponding independent divisional applications.

As mentioned above, the shaped piston of the selective locking device is movable between a first position and a second position, in which it holds the balls or the pin in the activation position or deactivation position of the rocker arm, respectively. The inventive aspect introduced thereby concerns the activation of the movement of the piston. As mentioned above, there is a spring, which forces the piston in the activation position and the activation is hydraulic (namely, oil under pressure is introduced into the cylinder in order to force the movement of the piston). According to prior art documents, the piston is manufactured as one single piece and, in this case, it is necessary to introduce an oil volume that corresponds to the movement of the piston from the first to the second position. According to the invention, the piston becomes a "piston device" and, in an inventive manner, it is manufactured in two pieces, namely in the cylinder there is a movable collar, which is cup-shaped and is fitted on the rod of the piston, the piston sliding relative to the collar. In particular, the collar comprises a bottom, which presses against a lip of the piston, whereas, on the opposite side (the one facing the balls), the collar is open so as to enable a relative movement of the piston. In order to deactivate the rocker arm, oil under pressure is introduced into the cylinder upstream of the collar (namely on the opposite side relative to the balls). Said oil under pressure generates the movement of the collar towards the balls and, as a consequence, a first movement (which is a dragging movement, due to the oil) of the piston. The needed oil volume does not correspond to the one used when there is no collar, but is smaller than that (there is an end-stop for the collar). Indeed, the shaped seat thereof simply needs to face the balls penetrating the cylinder in order to generate a second movement of the piston (which is a dragging movement, due to the balls), this time relative to the collar and with no further addition of oil. In order to re-activate the rocker arm, oil simply needs to be removed upstream of the collar. In the absence of this thrust, the spring, at first, causes the piston to return to the collar and, then, drags both bodies to their original position in which the balls activate the rocker arm.

As mentioned in the final portion of the part concerning the prior art, the switchable rocker arm according to the invention currently has its most advantageous application in a valve train group, in which said switchable rocker arm acts at least upon an exhaust valve bridge, while an engine brake rocker arm acts upon one of the exhaust valves of the valve bridge. In this way, two braking phases can be carried out per cycle. In this example, the hydraulic circuit operating the switchable rocker arm can also be the same operating the engine brake rocker arm with the presence of one single oil supplying valve. Preferably, valves that are exactly the same as the one described above can be used to supply different rocker arm groups (namely, with the sole switchable rocker arm or with the sole engine brake rocker arm). Indeed, the relative rocker arms simply need to be provided with oil supply channels, each time connected to dedicated holes of the valve (which are always present, but sometimes are not active). However, the application of the switchable rocker arm according to the invention is not limited to the sole application in cooperation with an engine brake rocker arm. Indeed, it can also be coupled to an intake valve bridge and the engine brake rocker arm can be absent. Naturally, hybrid versions are possible, in which, in a valve train assembly, only some valve bridges are provided with a switchable rocker arm and/or in some of them there is an engine brake rocker arm. In this description, FIG. 1 shows one of the many possible examples discussed above. In that sense, the invention also applies to a valve train group of an internal combustion engine with at least one switchable rocker arm according to the invention, which acts upon one single valve or a valve bridge.

BRIEF DESCRIPTION OF THE DRAWINGS

Further features and advantages of the invention will be best understood upon perusal of the following description of a non-limiting embodiment thereof, with reference to the accompanying drawings, wherein.

BEST MODE FOR CARRYING OUT THE INVENTION

Figure 1:
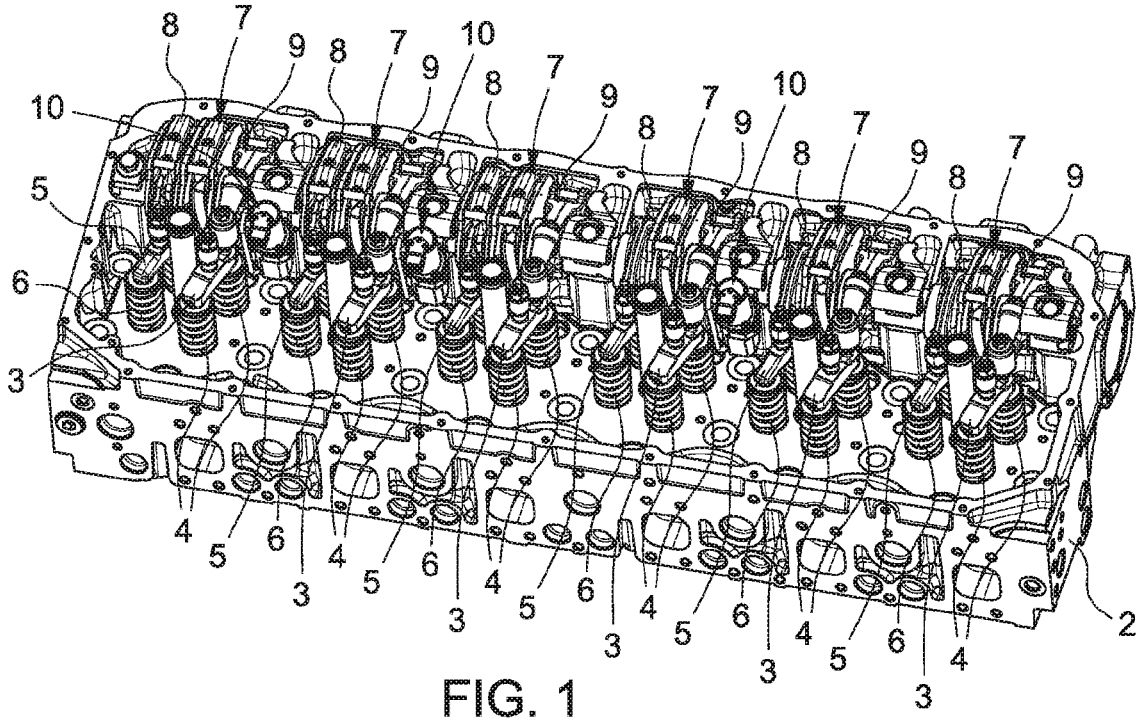
FIG. 1 shows an example of a valve train group comprising a plurality of switchable rocker arms according to the invention.

With reference, in detail, to the figures listed above, FIG. 1 shows an example of a valve train group (indicated, as a whole, with number 1) comprising a plurality of switchable rocker arms according to the invention. Said valve train group 1 is configured to control the lift of the valves of an internal combustion engine, which are partly visible in FIG. 1. In particular, FIG. 1 shows a cylinder head 2 of the engine, where there are obtained six in-line cylinders, which house, on the inside, movable pistons. The way in which an internal combustion engine works is very well known and, therefore, no further details are needed. In the example of FIG. 1, each cylinder is provided with two intake valves and with two exhaust valves. The lift cycles of these valves are traditional cycles of a 4-stroke engine and, in general, said lifts are operated by suitable rocker arms, which, in turn, are operated by a camshaft. The general operation of these rocker arms is known as well. In FIG. 1, number 3 indicates the exhaust valve bridges, each supporting two exhaust valves 4. Number 5 indicates the intake valve bridges, each supporting two intake valves 6. An exhaust rocker arm 7 acts upon each exhaust valve bridge 3. Even though FIG. 1 does not show details, each one of said exhaust rocker arms 7 is a switchable rocker arm according to the invention. An intake rocker arm 8 acts upon each intake valve bridge 5. In the example shown herein, the three intake rocker arms on the left are switchable rocker arms according to the invention, whereas the three remaining intake rocker arms on the right are known, non-switchable rocker arms. In the example of FIG. 1, the valve train group 1 further comprises 6 engine brake rocker arms 9, each acting upon an exhaust valve 4 of a cylinder. As already mentioned above, the example of FIG. 1 is just an example of the many possible combinations included in the invention. Indeed, the only condition the valve train group 1 has to fulfil is that of comprising a switchable rocker arm according to the invention, regardless of whether it is an exhaust or intake rocker arm or whether it acts upon a valve bridge or a single valve. The presence of engine brake rocker arms is not necessary either. However, the example shown herein proves to be very effective because, as it is known, it enables double braking phases per cycle and allows the engine cycles to be controlled in a very refined manner. Finally, number 10 of FIG. 1 indicates three oil supply valves. Said three valves, when needed, supply oil to the engine brake rocker arms and to the switchable rocker arms in a coordinated manner based on the needs of the manufacturer. A peculiar aspect of the invention concerning the three valves 10 lies in the fact that said valves are structurally identical to one another and the relative supply of oil to the different rocker arms only depends on the presence or absence of possible ducts obtained in the rocker arms. Indeed, where one of the different holes of the valve faces an inner duct of a rocker arm, the supply can take place, whereas, where there is no coupling, the supply cannot take place due to the lack of a duct on the inside of the rocker arm. By mere way of example, the left valve 10 supplies the three switchable intake rocker arms, the intermediate valve 10 supplies the three switchable exhaust rocker arms on the left, the right valve 10 supplies the three switchable exhaust rocker arms on the right and the six engine brake rocker arms. By operating the right valve and the intermediate valve, a control logic is activated; by operating the left valve and the intermediate valve, a different control logic is activated.

Figure 2:
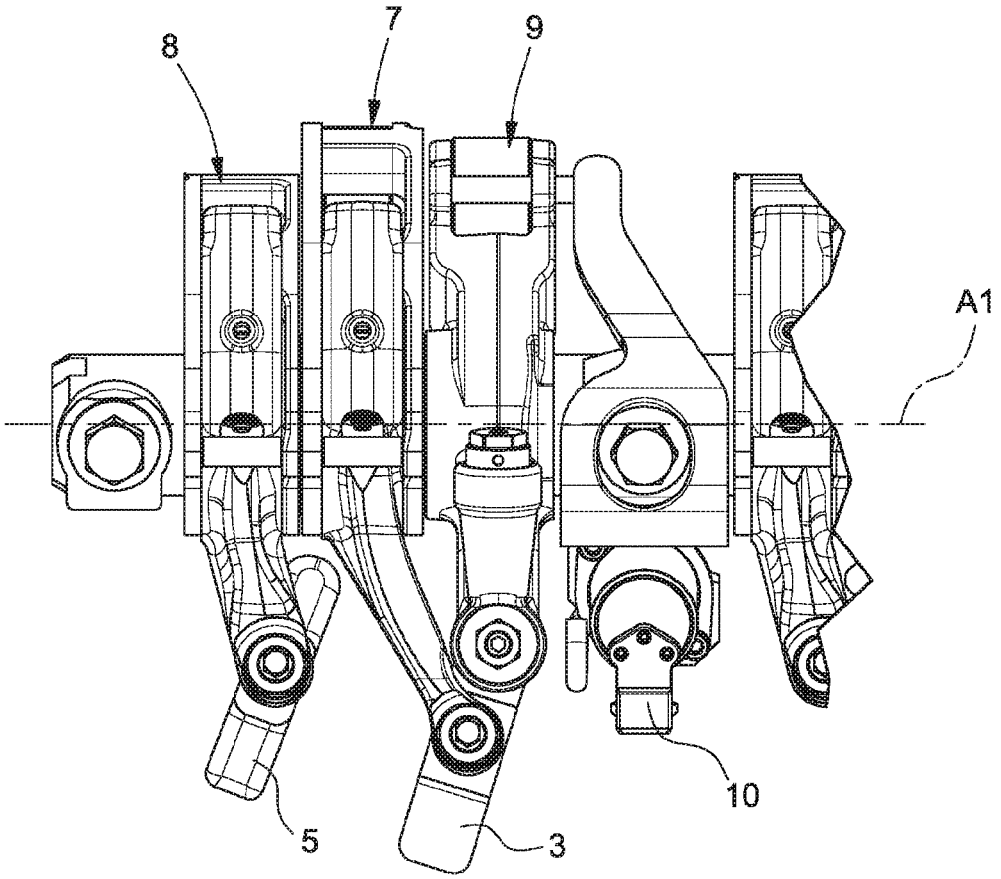
FIG. 2 shows an enlarged portion of the valve train assembly of FIG. 1.

FIG. 2 shows an enlarged portion of a portion of FIG. 1, namely the rocker arms associated with the left cylinder. This figure shows constructive details of a sub-assembly of FIG. 1, in which both the exhaust rocker arm 7 and the intake rocker arms 8 are switchable rocker arms according to the invention. Both rocker arms as well as the engine brake rocker arm 9 can rotate around the common axis A1, which is parallel to the axis of the camshaft.

Figure 3:
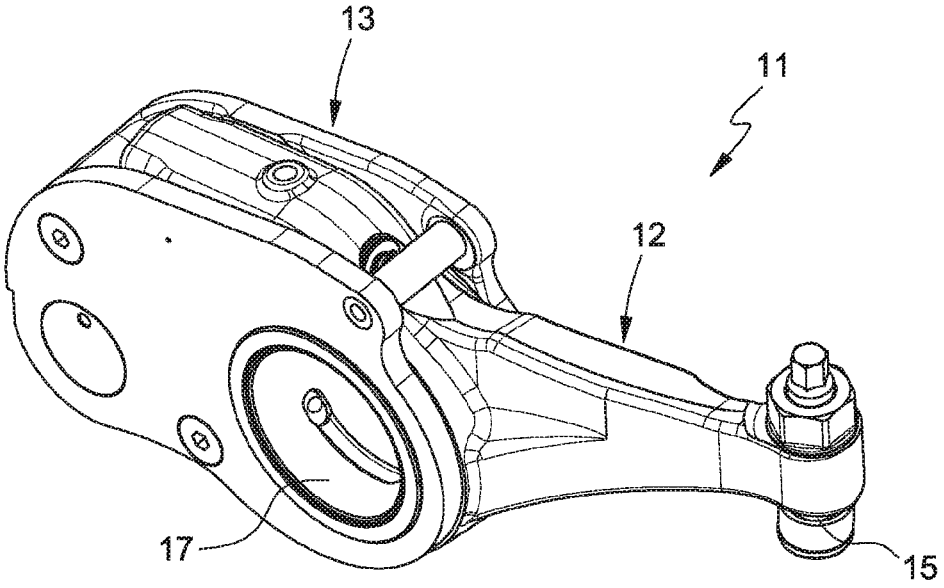
FIG. 3 shows a first example of a switchable rocker arm according to the invention.
Figure 4:
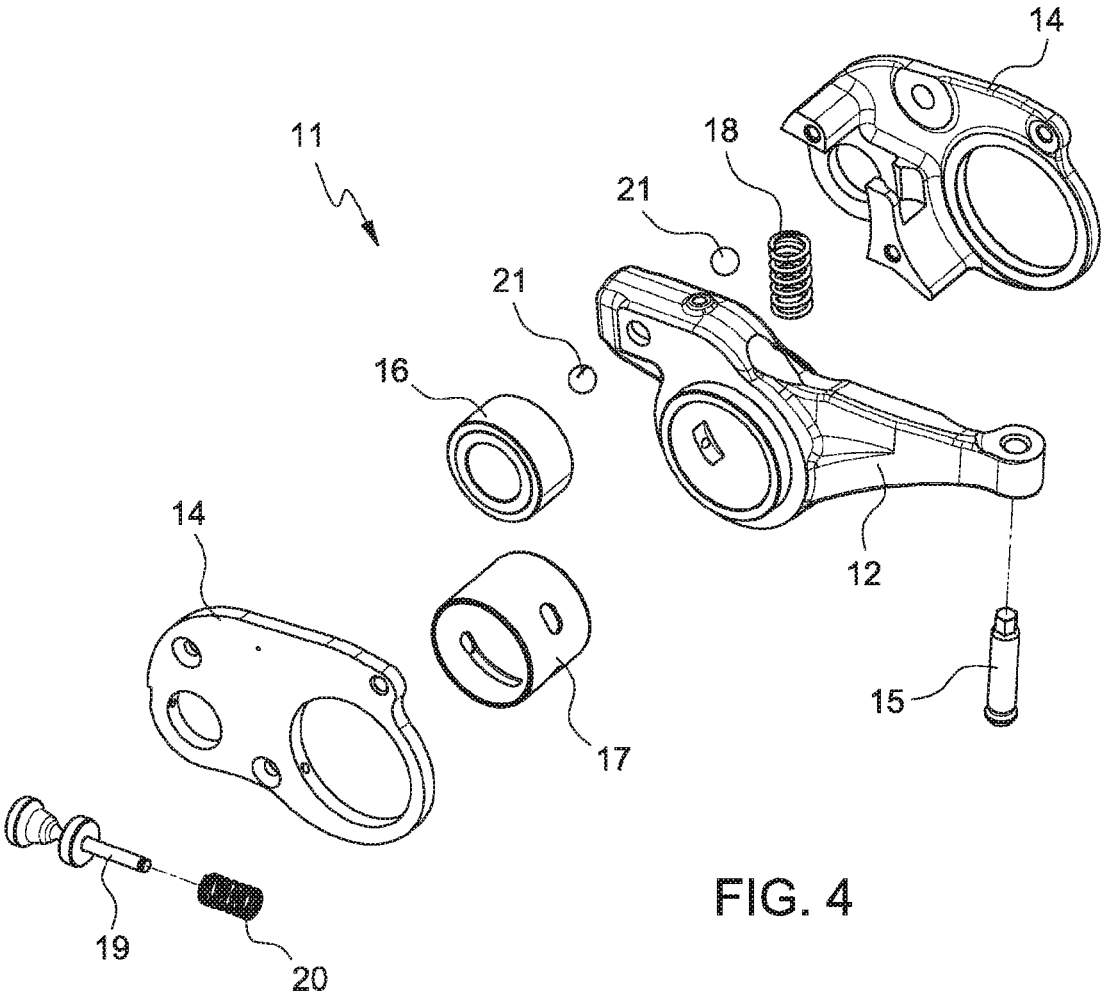
FIG. 4 shows an exploded view of the switchable rocker arm of FIG. 3.
Figure 5:
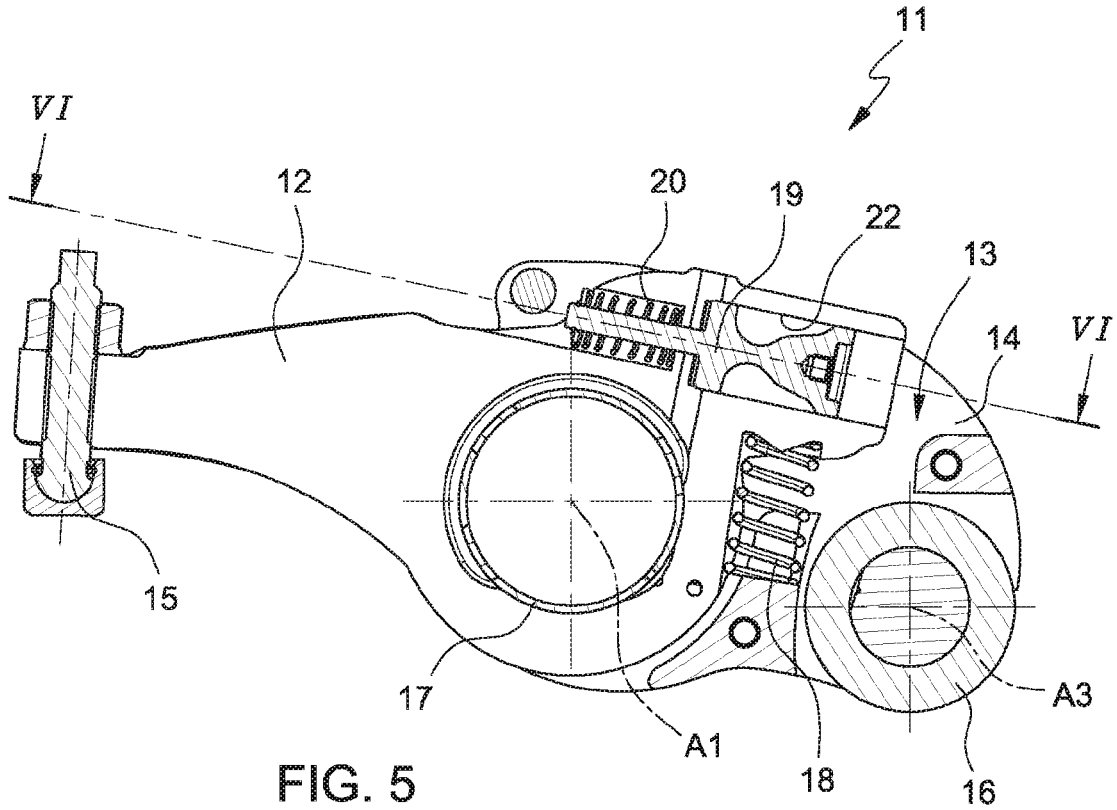
FIGS. 5 and 6 shown two cross sections of the switchable rocker arm of FIG. 3.
Figure 6:
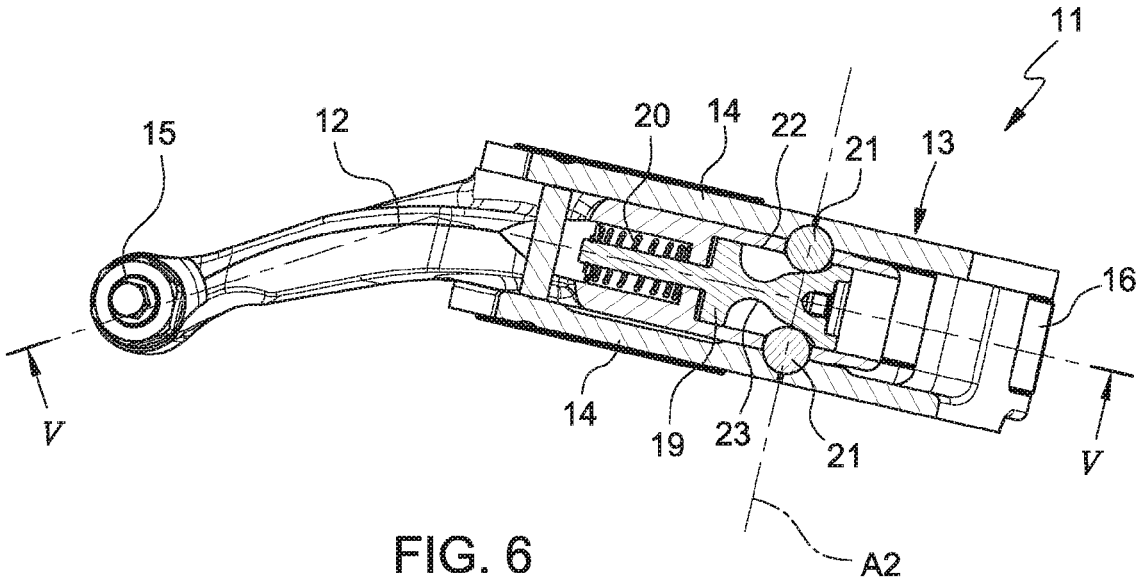
Figure 7:
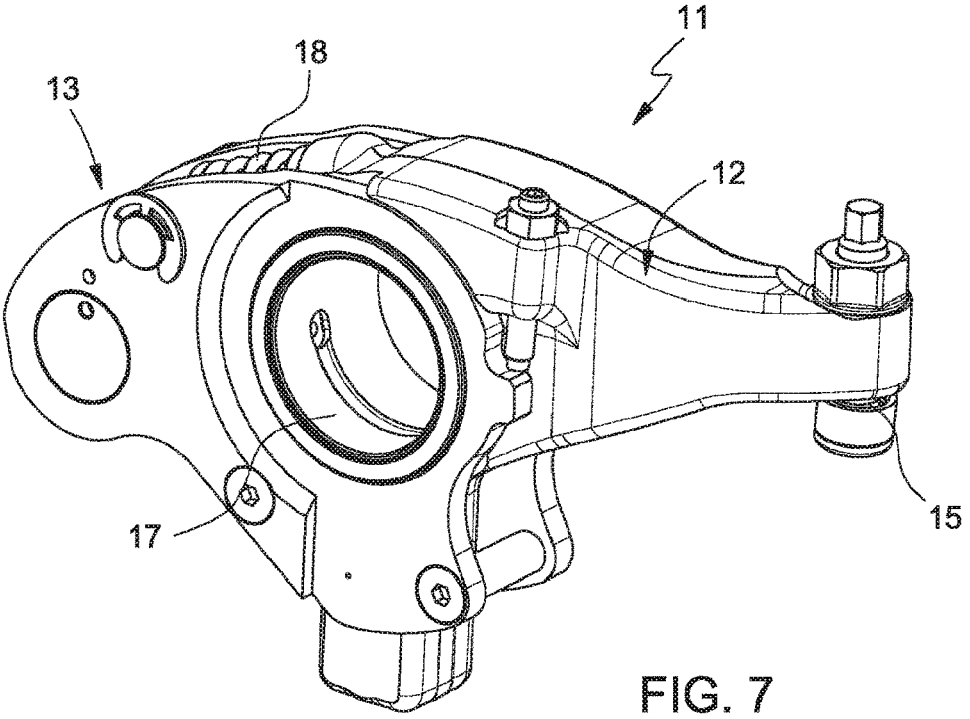
FIG. 7 shows a second example of a switchable rocker arm according to the invention.
Figure 8:
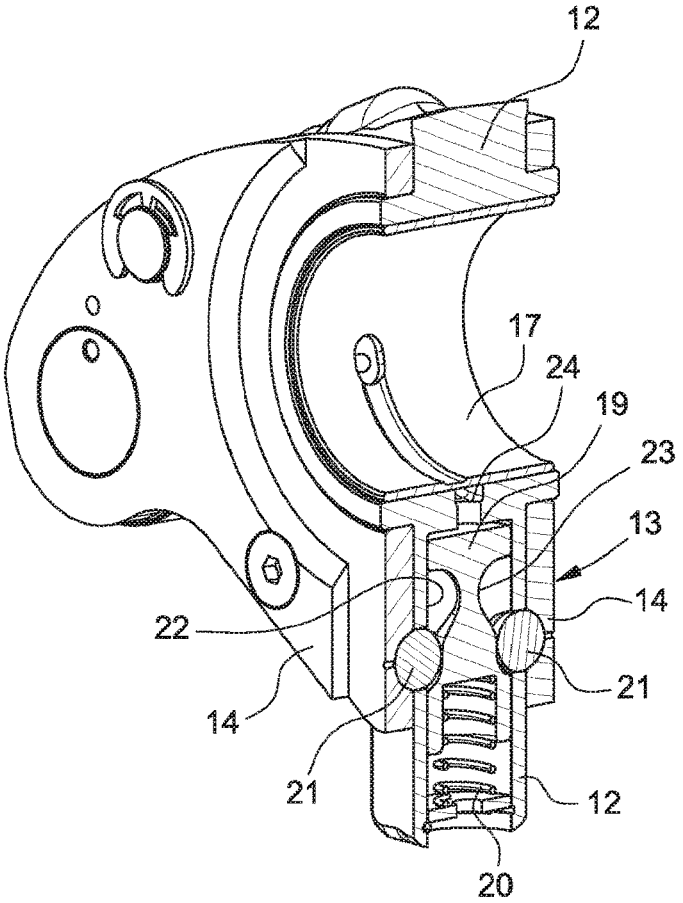
FIG. 8 shows a sectional view of the switchable rocker arm of FIG. 7.
Figure 9:
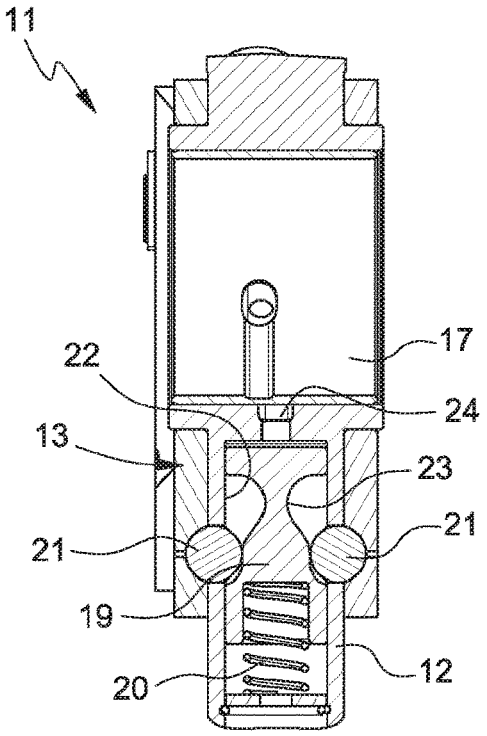
FIGS. 9 and 10 show the sectional view of FIG. 8 in two different use configurations.

FIGS. 3-6 show a first example of a switchable rocker arm according to the invention. Even though said rocker arm can be the rocker arm indicated with numbers 7 or 8 in the preceding figures, hereinafter, for the sake simplicity, number 11 will always be used for each switchable rocker arm according to the invention. The numbers indicated above were only used to highlight the multiple possible applications of the invention in a valve train group. In the example of FIGS. 3-6—and in general in the invention—the switchable rocker arm 11 comprises two bodies, a valve body 12 and a cam body 13 respectively, which cooperate with a valve or bridge valve and with a cam respectively. Like in known switchable rocker arms, the two bodies 12 and 13 are coupled to one another so as to assume two different configurations. In the first configuration, the rotation transmitted by the cam to the cam body 13 around the axis A1, namely around the axis of the shaft supporting the rocker arm, generates a movement or rotation of the valve body 12 around the axis A1 and, consequently, the lift of the valve or valve bridge is operated based on the profile of the cam. In the second configuration, the rotation transmitted to the cam by the cam body 13 around the axis A1 does not generate any movement of the valve body 12 and, hence, the lift of the valve or of the valve bridge is not operated based on the profile of the cam (actually, the lift is not operated at all). In a standard or non-switchable rocker arm, the two bodies 12 and 13 are always integral to one another or even manufactured as one single piece. For the purposes of this invention, the term "body" does not necessarily mean one single mechanical body, but it can also identify a plurality of components, which, however, once they are assembled, are always integral to one another. In that sense, FIG. 4 shows how, in this example, the cam body 13 is manufactured by joining two half-shells 14, whereas the valve body substantially is one single piece with the sole addition of a contact tip 15, which comes into contact with the valve or the valve bridge. Numbers 16 and 17 indicate the roller (having a third axis A3 parallel to the axis A1) coming into contact with the cam and a rotation bearing of the rocker arm, both of them being known elements. On the other hand, peculiar elements of the invention are indicated with numbers 18, 19, 20 and 21. According to FIGS. 5 and 6, number 19 indicates a movable piston, which is housed inside a cylinder 22 obtained in the valve body 12. The position of the cylinder 22 can change based on constructive needs. Said piston is hydraulically operated by the oil supplied by the valve 10 and, hence, is movable in the cylinder between a first and a second position. An inventive piston, or piston device, will be described below. The spring 20 forces the piston 19 in the first position, so that, in the absence of oil, the piston always is in said first position. Number 21 indicates 2 balls arranged in opposite positions relative to the piston 19. According to FIG. 6, which shows the first position of the piston 19, in this configuration the balls 21 are housed between the bodies 12 and 13 and are held in this position, on one side, by the piston 19 and, on the other side, by a semi-spherical seat 23 obtained in the cam body 13. Hence, when the piston 19 is in said position, the balls 21 are locked as shown in the figure and act as structural bridge between the bodies 12 and 13, so that the rotation of the cam body 13 operated by the cam generates, through dragging, a movement of the valve body 12. There are no further mechanical bridge elements between the two bodies, besides the aforesaid balls 21. When the piston 19 is lifted (namely, when the valve 10 is activated so as to supply oil into the cylinder), the latter moves so as to allow a portion with a reduced thickness 23 to reach the area of the balls 21. Said reduced thickness 23 is configured so as to allow the balls 21 to penetrate the cylinder 22. In this configuration, the balls 21 move along the axis A2 (shown in FIG. 6), which is parallel to the axis A1, towards the inside of the cylinder and do not cooperate any longer with the cam body 13 in order to transmit the motion to the valve body 12. In this condition, the rotation of the cam body 13 due to the cam, which takes place around the axis A1, does not generate a corresponding movement of the valve body 12. Finally, number 18 indicates a spring, which is designed to hold the two bodies 12 and 13 assembled together.

Figure 10:
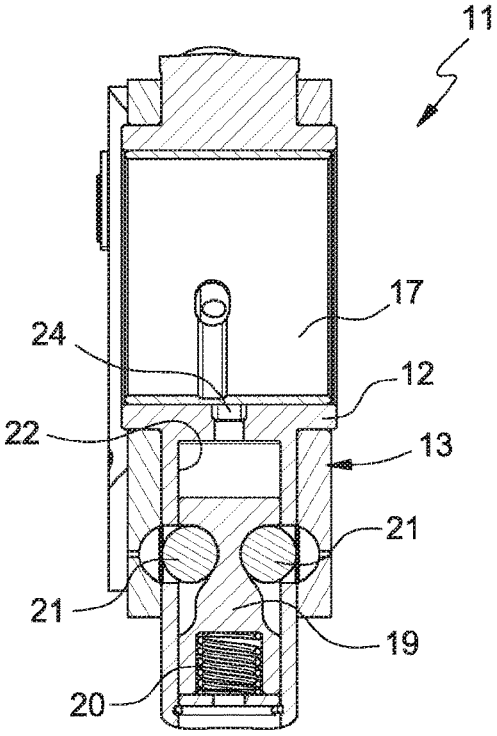

FIGS. 7-10 show a second example of a switchable rocker arm according to the invention. This example uses the same reference numbers used in the description of the preceding example, as the mechanical components are the same. The difference between the two examples solely lies in the profile of the bodies, due to different mechanical side conditions, and in the space arrangement of the spring 18, of the piston 19 and of the balls 21. However, the operation of this example is exactly the same as the one of the preceding example. FIG. 10 further shows the second configuration with the balls 21 housed in the cylinder 22, which was not shown in the preceding example. Number 24 indicates the channel supplying oil to the cylinder 22.

Figure 11:
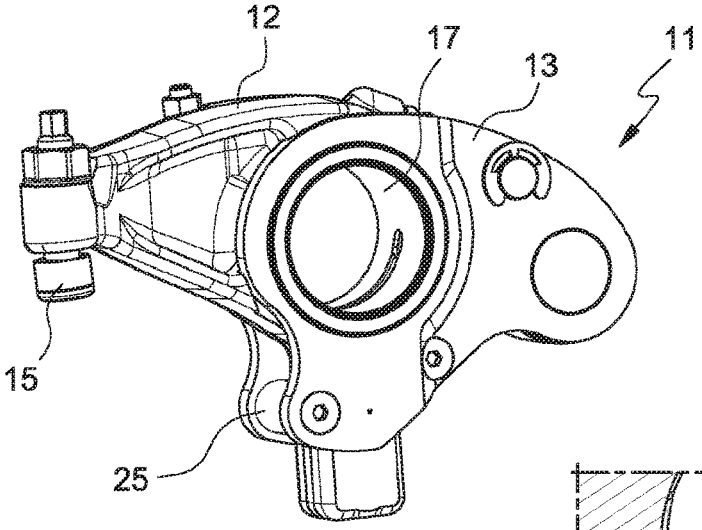
FIG. 11 shows a third example of a switchable rocker arm according to the invention.
Figure 12:
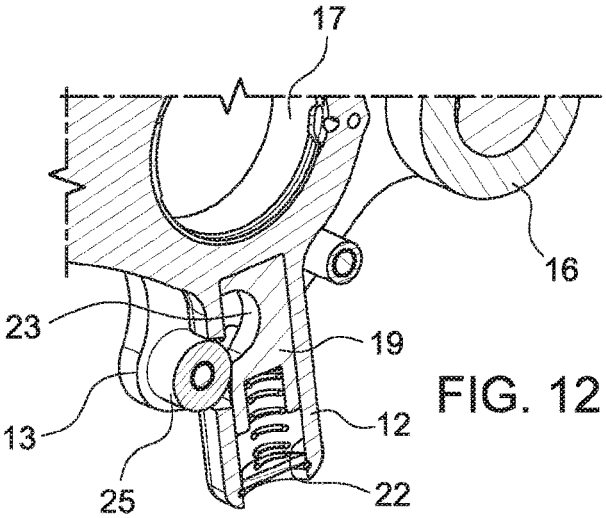
FIG. 12 shows a sectional view of the switchable rocker arm of FIG. 11.

FIGS. 11 and 12 show a third embodiment of the invention. In this example, which is structurally similar to the preceding example, the balls 21 are no longer present and are replaced by a pin 25 with an axis orthogonal to the one of the piston 19 and integral to the cam body 13. In this example, again, in the first configuration (visible in detail in FIG. 12), the pin 25 is at an opening of the cylinder 22 striking against the piston 19 so that, like the balls, it can act as mechanical bridge between the bodies 12, 13 and, hence, the rotation of the cam body generates a movement of the valve body. In this example, again, the piston 19 has a portion with a reduced thickness. In particular, in this case, the portion with a reduced thickness creates a C-shaped seat housing the pin 25, so that, in the second position of the piston 19, the pin is housed in the cylinder 22 and, like the balls, does not drag the valve body 12 during the rotation of the cam body 13.

Figure 13:
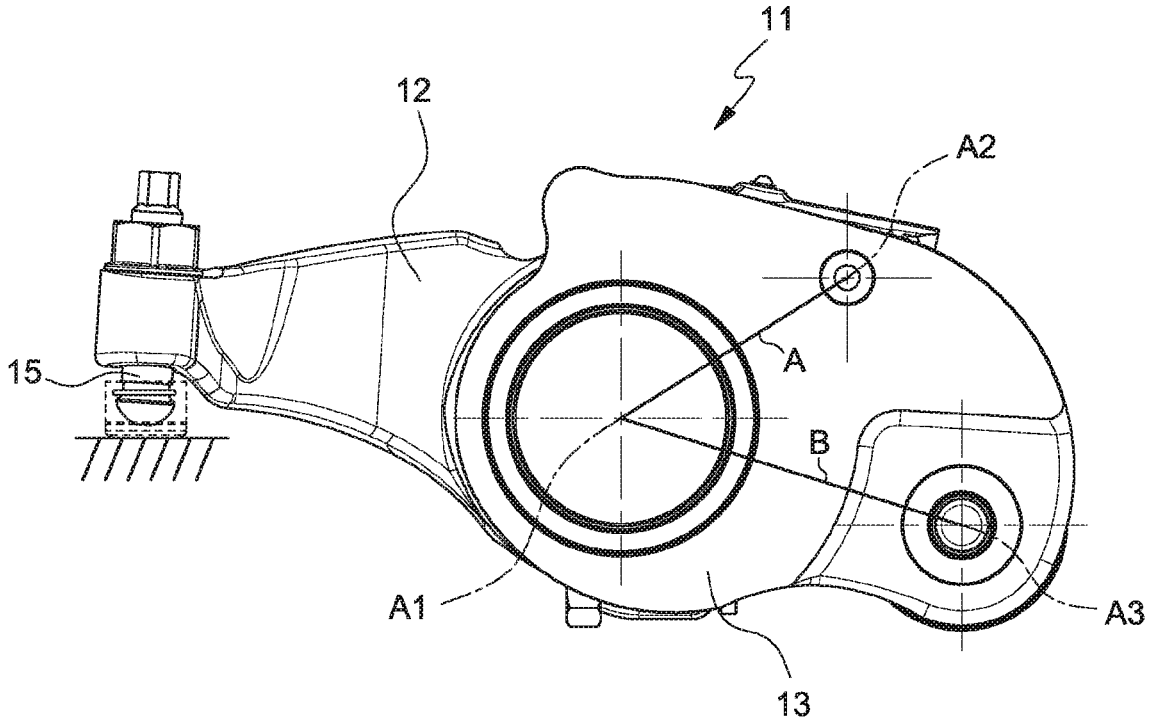
FIG. 13 shows a side view of a rocker arm of the type of FIG. 3, in which a geometric/mechanical condition required by the invention is shown.

FIG. 13 shows a side view of a rocker arm of the type of FIG. 3, in which a geometric/mechanical condition required by the invention is shown. The condition set by the invention is that the distance A between the first axis A1 (only rotation axis of the rocker arm) and the second axis A2 (movement axis of the balls or of the pin) is greater than 0.75 times the distance B between the first axis A1 and the third axis A3 of the roller 16. This condition ensures that the stress affecting the balls or the pin in the active rocker arm configuration does not exceed threshold values, which could lead to a damaging of the device itself.

Figure 14:
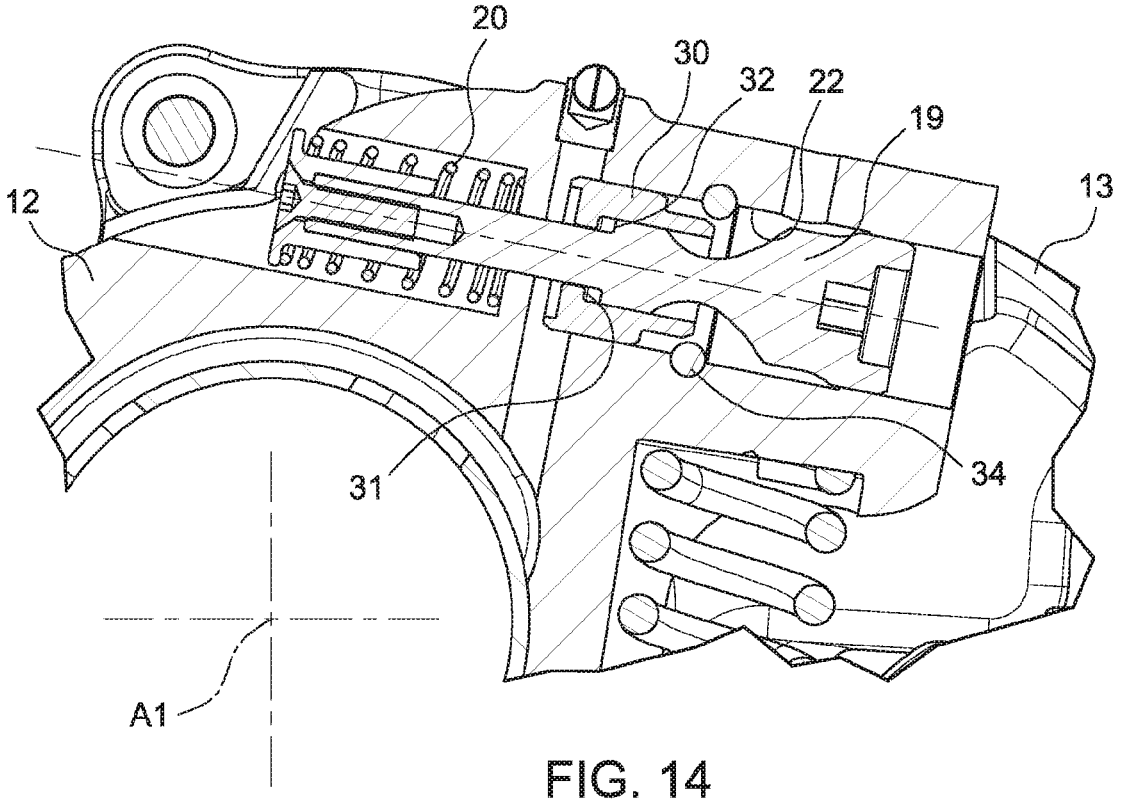
FIGS. 14 and 15 show a novel piston device which can be used in cooperation with the locking balls or pin, said novel piston device needing a smaller oil volume for the deactivation of the rocker arm.
Figure 15:
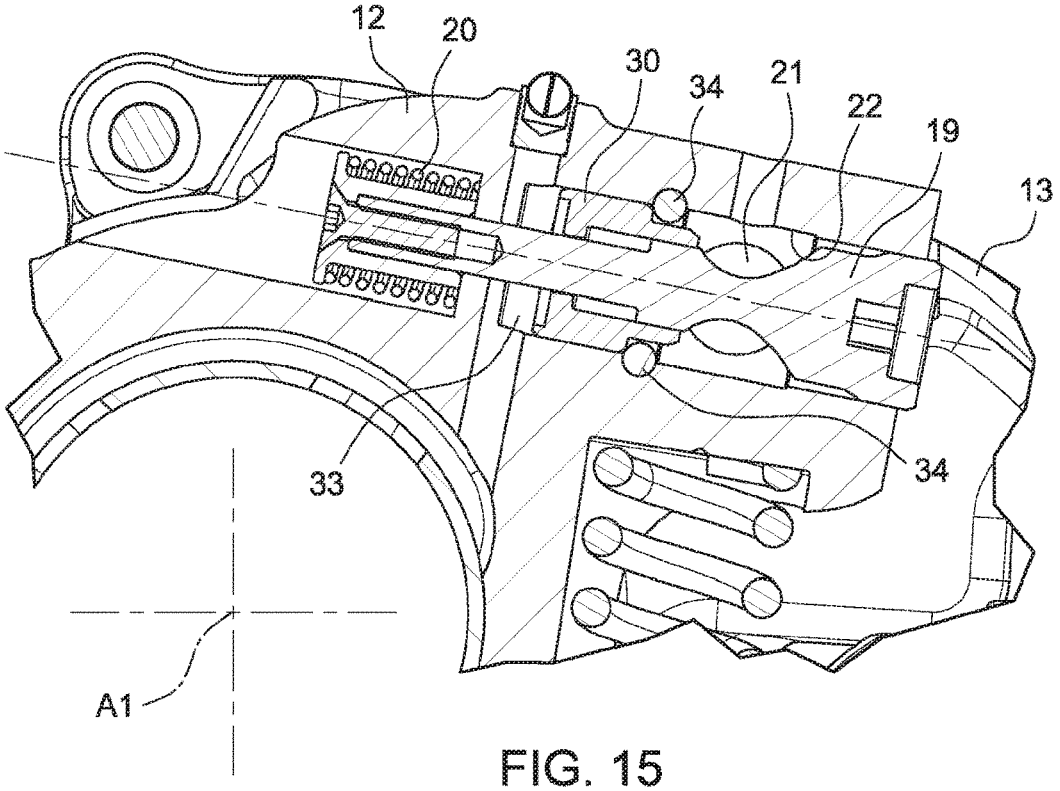

FIGS. 14 and 15 show a novel piston device, which can be used in cooperation with the locking balls 21 or pin 25. As mentioned above, the shaped piston 19 is movable between a first position (FIG. 14) and a second position (FIG. 15), in which it holds the balls 21 (or the pin) in the activation position or deactivation position of the rocker arm, respectively. The inventive aspect introduced thereby concerns the activation of the movement of the piston 19. As mentioned above, there is a spring 20, which forces the piston 19 in the activation position and the activation is hydraulic, namely oil under pressure is introduced into the cylinder 22 in order to force the movement thereof. According to the invention, the piston 19 of FIG. 5 becomes a "piston device" and, in an inventive manner, it is manufactured in two pieces, namely in the cylinder 22 there is a movable collar 30, which is cup-shaped and is fitted on the rod of the piston 19. The piston 19, at first, is dragged by the collar 30 and, then, can slide relative to the collar 30 in the following manner. The collar 30 comprises a bottom 31, which, when operated by the oil introduced into the cylinder 22, acts so as to strike against a lip 32 of the piston 19. On the opposite side (the one facing the balls 21), the collar 30 is open so as to enable a relative movement of the piston 19 allowing it to get closer to the balls 21. The starting position (FIG. 14) of the collar 30 and of the piston 19 is maintained by the spring 20. In order to deactivate the rocker arm, oil under pressure is introduced into the cylinder 22 upstream of the collar 30 (in the chamber indicated with 33 in FIG. 15, on the opposite side relative to the balls). Said oil under pressure generates the movement of the collar 30 towards the balls 21 and, as a consequence, a first movement (which is a dragging movement, due to the oil) of the piston 19. The piston 19 can slide relative to the collar towards the balls and the shaped seat of the piston simply needs to face the balls 21 penetrating the cylinder 22 in order to generate a second movement of the piston 19 (which is dragging movement, due to the balls) when the collar 30 is standing still. A suitable end stop element 34 is provided in order to stop the stroke of the collar as indicated above. Hence, the second part of the movement of piston is not due to a further oil volume introduced, but is generated by the balls (or by the locking device in general) after the first initial movement caused by the short movement of the collar 30. In order to re-activate the rocker arm, oil simply needs to be removed upstream of the collar 30. In the absence of this hydraulic thrust, the spring 20, at first, causes the piston 19 to strike again against the bottom 31 of the collar 30 and, then, drags both bodies 19, 30 to their original position in which the balls 21 are out of cylinder 22 activate the rocker arm.

Figure 16:
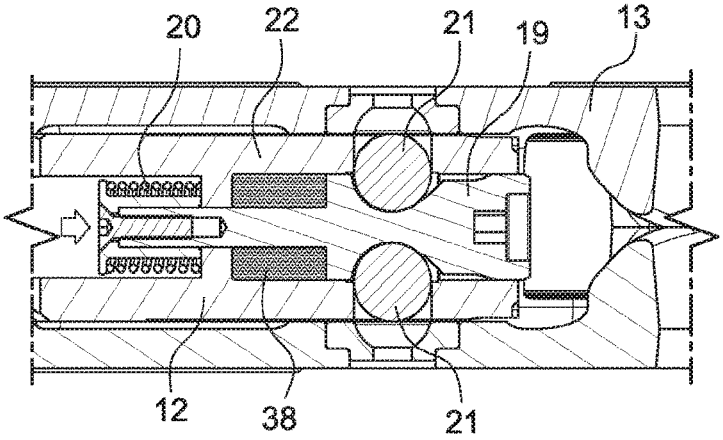
FIGS. 16 and 17 show a comparison of the oil volume needed for the deactivation of the rocker arm with a known and with a novel piston device.
Figure 17:
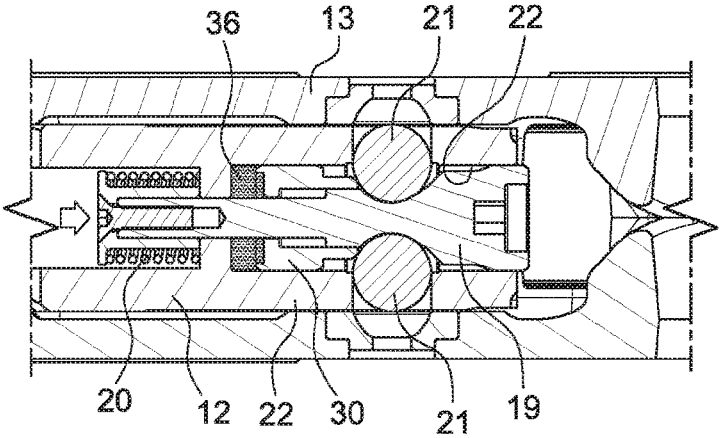

FIGS. 16 and 17 show a comparison of the oil volume needed for the deactivation of the rocker arm with a one-piece piston and with a novel piston device with sequential sliding or with two pieces. Evidently, the oil volume needed (references 35 and 36 in FIGS. 16 and 17) with the novel piston device does not correspond to the one needed in the absence of collar and is much smaller than that. In the example shown herein, the improved version of the piston device needs approximately ⅓ of the oil needed by the one-piece piston in the same conditions, namely the volume to be filled with oil in the cylinder is circa ⅓ of the original volume.

Finally, it is clear that the invention described herein can be subjected to changes and variations, without for this reason going beyond the scope of protection of the appended claims. As a matter of fact, the main aspect shared by all the examples of the invention is the presence of one single rotation axis of the rocker arm A1, of the geometric condition setting a ratio between the distance of the axes A1-A2 and A1-A3 and of the movable piston (preferably of the novel two-piece piston device), which is housed inside only one of the bodies and, when operated, allows a locking element or mechanical bridge (preferably, in the form of balls or pin as shown herein) to penetrate the cylinder. Preferably, and for safety reasons, the system is configured so that, in the absence of oil, it steadily is in the first configuration (integral bodies). The rocker arm according to the invention can have multiple applications in a valve train group. In the example shown herein, with six in-line cylinders, all the exhaust rocker arms and three intake rocker arms are switchable rocker arms according to the invention and cooperate with six engine brake rocker arms. In order to allow for many different applications without multiplying costs, the invention also entails using oil supply valves that are all the same and each time intercept different supply channels depending on the nature of the rocker arms.

The invention claimed is:

1. A switchable rocker arm for controlling a lift of a valve bridge or of a single valve of a valve train group of an internal combustion engine; the switchable rocker arm being rotatable around a first axis and comprising:

a cam body configured to be driven in rotation by a cam about the first axis;

a valve body configured to act on the valve bridge or on the single valve;

wherein the switchable rocker arm is selectively switchable between a first configuration, in which the rotation of the cam body about the first axis generates a movement of the valve body about the first axis, and a second configuration in which the rotation of the cam body about the first axis does not generate any movement of the valve body;

characterized in that inside the cam body or the valve body a cylinder is obtained for housing a sliding shaped piston movable between a first position and a second position; and the switchable rocker arm comprising a locking device which cooperates with the shaped piston and configured in such a way that:

in the first position of the piston the locking device acts simultaneously on the cam body and on the valve body so as to constrain the switchable rocker arm in the first configuration; and in the second position of the piston the locking device enters the cylinder so that the switchable rocker arm is in the second configuration;

wherein inside the cylinder a mobile collar is provided around a stem of the piston, the piston and the collar being configured so that for passing from the first to the second position the piston performs a first movement forced by hydraulically driven movement of the collar and thereafter the piston performs a second movement with the collar fixed forced by the penetration of the locking device inside the cylinder.

2. The switchable rocker arm as claimed in claim 1, wherein the locking device comprises two balls movable along a second axis parallel to the first axis depending on the position of the piston for moving from the first position, wherein the balls act simultaneously on the cam body and on the valve body to constrain the switchable rocker arm into the first configuration, to the second position wherein the balls penetrate inside the cylinder so that the switchable rocker arm is in the second configuration and vice-versa.

3. The switchable rocker arm as claimed in claim 2, wherein the cam body comprises a roller having a third axis parallel to the first axis and in contact with the cam; the distance between the first axis and the second axis being more than 0.75 times the distance between the first axis and the third axis.

4. The switchable rocker arm as claimed in claim 1, wherein the shaped piston is hydraulically actuated, a spring configured to force the piston into the first position being provided.

5. The switchable rocker arm as claimed in claim 1, wherein the collar comprises a bottom configured for acting on a lip of the piston during an oil supply inside the cylinder for pushing the piston during the first movement.

6. The switchable rocker arm as claimed in claim 5, wherein inside the cylinder an end-stop for the collar is provided in a position so that, at the end of a stroke of the collar, a shaped portion of the piston is only in part facing the locking device, the locking device penetrating inside the cylinder generating the second movement of the piston.

7. The switchable rocker arm as claimed in claim 1, between the cam body and the valve body a spring is provided and configured to force the switchable rocker arm in the first configuration.

8. A valve train assembly for controlling a valve lift of an internal combustion engine, the valve train assembly comprising:

a camshaft;

a plurality of rocker arms driven by the camshaft to control the valve lift;

wherein at least one of the rocker arms is the switchable rocker arm according to claim 1.

9. The valve train assembly as claimed in claim 8, wherein the valve train assembly further comprises a plurality of inlet valve bridges and a plurality of exhaust valve bridges; at least one switchable rocker arm being provided coupled to an exhaust valve bridge.

10. The valve train assembly as claimed in claim 8, wherein the valve train assembly further comprises at least one switchable rocker arm coupled to an intake valve bridge.

11. The valve train assembly as claimed in claim 8, wherein the valve train assembly further comprises at least one engine brake rocker arm coupled to an exhaust valve.

* * * * *